United States Patent [19]

Daniel

[11] Patent Number: 4,912,478

[45] Date of Patent: Mar. 27, 1990

[54] SIGNAL TIME DELAY MAGNETOSTATIC SPIN WAVE DEVICE FOR PHASED ARRAY ANTENNAS

[75] Inventor: Michael R. Daniel, Monroeville, Pa.

[73] Assignee: Westinghouse Electric Corp., Pittsburgh, Pa.

[21] Appl. No.: 288,385

[22] Filed: Dec. 22, 1988

[51] Int. Cl.[4] ..... H01Q 3/22

[52] U.S. Cl. ..... 342/375; 333/147; 333/148

[58] Field of Search ..... 342/375, 372; 333/147, 333/148

[56] References Cited

U.S. PATENT DOCUMENTS 4,675,682 6/1987 Adam et al. ..... 342/375

OTHER PUBLICATIONS

V. B. Anfinogenov et al., Propagation of Magnetostatic Waves in a Ferrite-Ferroelectric Structure, The Soviet Technical Physics Letters 12(4), Apr. 1986.

*Primary Examiner*—Theodore M. Blum

*Attorney, Agent, or Firm*—G. S. Grunebach

[57] ABSTRACT

A phased array radar antenna utilizing signal time delay magnetostatic spin wave devices operable to provide feed line transmit time control for variable length transmission feed lines. The preferred embodiment of an improved phased array radar antenna incorporates ferrite devices controlled by d.c. voltage driven ferroelectrics.

5 Claims, 2 Drawing Sheets

SIGNAL TIME DELAY MAGNETOSTATIC SPIN WAVE DEVICE FOR PHASED ARRAY ANTENNAS

BACKGROUND OF THE INVENTION

1. Field of the Invention

The present invention relates to phased array radar system, and more particularly to signal time delay devices which include magnetostatic spin wave elements used to time delay the transmitted signals.

2. Description of the Prior Art

Present day phased array radar antennas are electronically steered by a phase shifting circuit element in each radiating element of the array.

For steering purposes an emitted signal is subjected to a phase shift of no more than $2\pi$ radians as provided by each phase shifting circuit element. However, many of these phased array radar antennas are physically tens of feet across. A waveguide signal feed system which feeds, or provides a signal for each radiating element of the array, driven by a signal generated by an oscillator would comprise a multiplicity of waveguides of varying length dependent upon the location of the emitting element. The location of the radiating or emitting element would determine the length of the waveguide feed. Thus, the signal transit time from the oscillator generating the signal through the multiplicity of individual waveguides to the variously located radiating or emitting elements of the antenna array would not be constant across the array. The leading and trailing edges of a transmitted pulse would suffer signal degradation because not all of the elements are illuminated at the same time for these leading and trailing edges.

Present solutions to this problem of variable signal transit time involve the addition of phase shifts of multiples of $2\pi$ to the antenna system. This addition of $2\pi$ of phase shifting creates beam steering through the control of a relatively small phase angle of $2\pi$ radians on top of a fixed but greater signal shift of $2n\pi$ radians, where n is an integer.

A paper authored by V. B. Anfinogenov, T. N. Verbitskaya, P. E. Zil'berman, G. T. Kazakov and V. V. Tikhonov entitled "Propagation of Magnetostatic Waves in a Ferrite-Ferroelectric Structure", published in The Soviet Technical Physics Letters, 12 (4), April 1986, describes the change in group velocity in a magnetostatic wave (MSW) when a ferrite supporting the wave is placed into contact with a ferroelectric material. However, the practical application of this device as a time delay device was not described.

The problem to be solved therefore is the equalization of signal transit times in the feed lines of phased array antennas by adjustable time delay instead of through $2\pi$ phase shifters.

SUMMARY OF THE INVENTION

In accordance with the above requirements, the present invention provides feed line transit time control without the use of phase shifters operable to phase shift through $2\pi$ radians. Specifically, a phased array radar system comprising a signal generator, operable to produce a signal having a predetermined frequency feeds a multiplicity of signal transmission lines. The signal transmission lines are of varying lengths due to the location of the emitting elements positioned in the antenna array. At least one signal, time delay magnetostatic spin wave device, operable to time delay the signals receives these signals from the signal transmission lines. In series with the magnetostatic spin wave devices, phase shifters, one for each transmission line, provide signal phase shifting to the time delayed signals. Finally, emitters receive the time delayed, phase shifted signals and transmit these signals outside of the phased array antenna system.

This invention also encompasses a phased array radar system incorporating this time delay magnetostatic spin wave device, as a method of signal time delay using the device.

BRIEF DESCRIPTION OF THE DRAWINGS

For a better understanding of the invention, reference may be had to the preferred embodiment exemplary of the invention, shown in the accompanying drawings, in which.

DESCRIPTION OF THE PREFERRED EMBODIMENT

Figure 1:
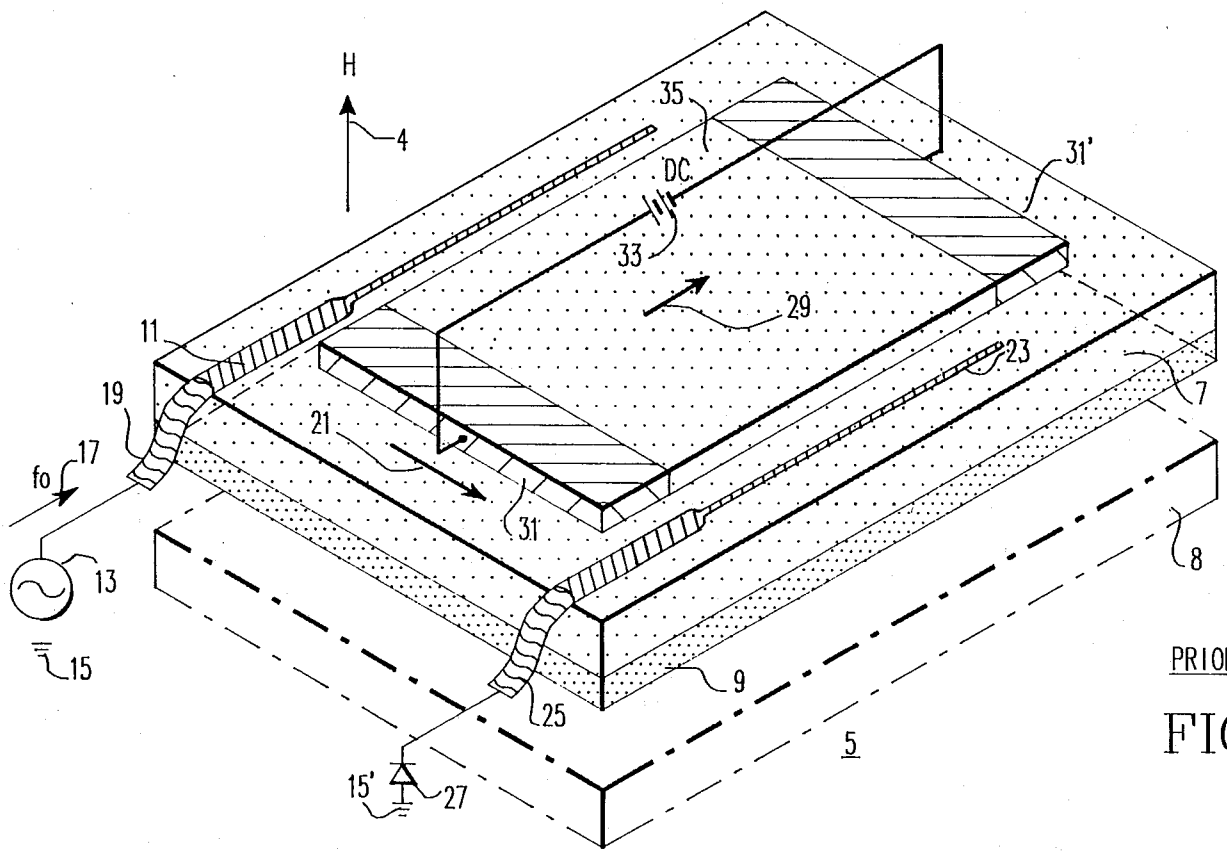
PRIOR ART FIG. 1
FIG. 1 is a schematic representation of the prior art, a signal time delay magnetostatic spin wave device.

FIG. 1 is a schematic representation of the prior art a signal time delay magnetostatic spin wave device 5. This device 5 comprises a layer of ferrite 7 mounted upon a support structure 9. The ferrite 7 is bathed in a magnetic field 8 produced by magnet 4. A ferrite 7 such as yttrium iron garnet (YIG) operable to produce a traveling or propagating magnetostatic spin wave could be layered for example, upon a supporting structure 9 of gadolinium gallium garnet (GGG). A first transducer 11 is in contact with the surface of the ferrite 7 and is operable to be electrically connected to an oscillator 13 which is also connected to ground 15. This oscillator 13 is capable of generating a signal $f_o$, as indicated by arrow 17 which enters the first transducer 11 through input port 19. This signal $f_o$, generates a traveling wave in the direction of the arrow 21 through the ferrite 7. This traveling wave is time delayed as discussed below before exiting the ferrite 7 by second transducer 23 also in contact with the surface of the ferrite 7. The second transducer 23 is parallel to the first transducer 11 and both may comprise, for example, gold (Au) evaporated or photolithographically defined upon the material 7 surface. Output port 25 is interconnected to a detector diode 27 and ground 15' where the output port 25 is operable to receive time delayed signal 21.

Mounted upon the ferrite 7 substrate, as shown in FIG. 1 prior art is a ferroelectric 29 as for example conformed as a slab. This ferroelectric 29 has two metalization layers 31, 31' at opposite ends of the ferroelectric 29. A direct current voltage source 33 is electrically connected to the metalization layers 31, 31' such that an electric field indicated by arrow 35 is generated through the ferroelectric slab 29 between the two plate-like metalization layers 31, 31'. This electric field within the ferroelectric 29 is static, and perpendicular to the magnetostatic spin wave 21 propagating through the ferrite 7 between the input or first transducer 11 and the output or second transducer 23. The presence of the high dielectric ferroelectric material 29 changes the boundary condition for the propagating magnetostatic spin wave 21 at the ferrite-ferroelectric interface. These changed boundary condition results in a changed in the time of travel of the magnetostatic spin wave 21 between the input and output transducers. The static electric field in the ferroelectric 29 serves to control the dielectric constant of this material 7 and thus to control the ferrite-ferroelectric boundary condition. Hence it controls the magnetostatic spin wave time delay.

In summary, the bias voltage generated by the d.c. source 33 placed upon the ferroelectric 29 alters its dielectric constant. This change in the dielectric constant affects the magnetostatic spin wave 21 in the ferrite 7.

Figure 2:
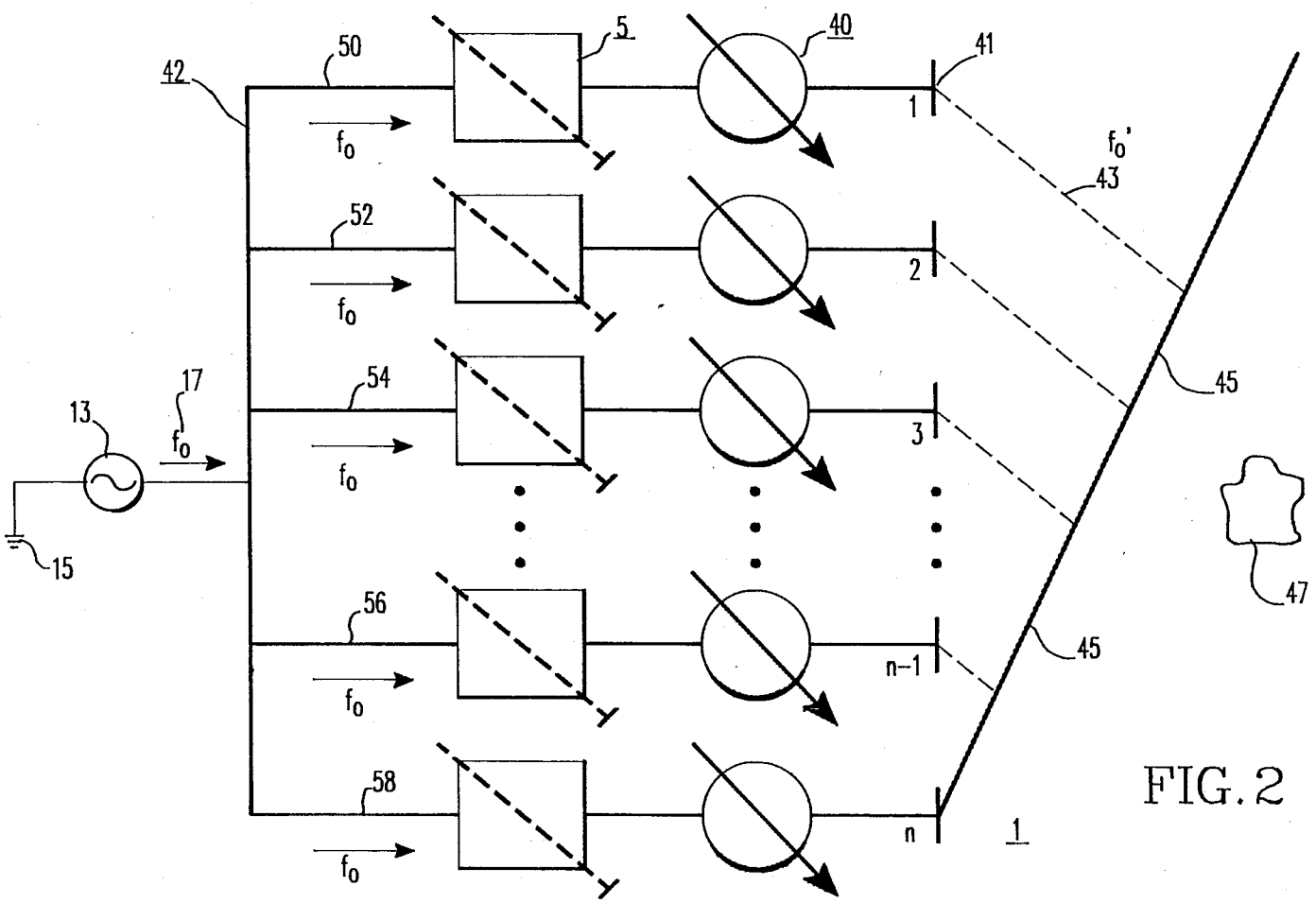
FIG. 2 is a schematic representation of the preferred embodiment of a phased array radar system incorporating the prior art signal time delay magnetostatic spin wave device.

FIG. 2 is a schematic representation of the preferred embodiment of a phased array radar system 1 incorporating the prior art signal time delay magnetostatic spin wave device 5. The improved array radar system 1 must emit a signal $f_o$ which is generated by variable oscillator 13. The signal $f_o$ enters and is supplied to a plurality of emitting radiators 41. The signal $f_o$ enters each of the delay devices 5 where the signal is time and phase delayed to compensate for the different length of the waveguide feed lines 42. For example, each of the lines 50, 52, 54, 56 and 58 as shown in FIG. 2 are of a different length due to the width of the array of emitting elements 41. The signal 17 then enters the individual phase shifting devices 40. These phase shifting devices 40 phase shift the signal $f_o$ up to a maximum of $2\pi$ radians, where these devices are interconnected to each radiating or emitting device 41. The emitted signals $f_o'$, which have been phase shifted and delay equalized form a wave front 45 which is directed towards a target 47 outside of the array 1.

Numerous variations may be made in the above-described combination and different embodiments of this invention may be made without departing from the spirit thereof. Therefore, it is intended that all matter contained in the foregoing description and in the accompanying drawings shall be interpreted as illustrative and not in the limiting sense.

We claim:

1. A phased array radar antenna, comprising:

a means to generate a signal, said signal having a predetermined frequency;

a multiplicity of signal transmission means, each of said signal transmission means having a distinct physical length;

at least one signal time delay magnetostatic spin wave device for each of said signal transmission means, said signal time delay magnetostatic spin wave devices comprising a ferrite, said ferrite having a top surface, said ferrite operable to propagate a magnetostatic spin wave, a first transducer for receiving an oscillating signal, said first transducer cooperatively associated with said top surface of said ferrite, a second transducer for detecting said oscillating signal, said second transducer cooperatively associated with said top surface of said ferrite, said second transducer being positioned parallel to said first transducer on said top surface of said ferrite; and a ferroelectric, said ferroelectric mounted upon said top surface of said ferrite, said ferroelectric having a first and a second metalization layer, said first and said second metalization layers positioned opposite one another upon said ferroelectric, said first and said second metalization layers operable to maintain a static electric field between said first and said second metalization layers when a d.c. voltage is electrically connected to said first and said second metalization layers of said ferroelectric, said static electric field operable to time delay said signal propagating through said ferrite, said signal time delay magnetostatic spin wave devices operable to time delay said signals received from said signal transmission means;

at least one signal phase shifter in series with each of said signal time delay magnetostatic spin wave devices, said phase shifters operable to phase shift said time delayed signals received from said signal time delay magnetostatic spin wave devices; and at least one emitter for each of said signal transmission means, said emitters operable to emit said time delayed phase shifted signals received from said phase shifters.

2. A phased array radar antenna, as in claim 1, wherein said ferrite further comprises a layer of yttrium iron garnet (YIG) upon a layer of gadolinium gallium garnet (GGG).

3. A phased array radar antenna, as in claim 1, wherein said ferroelectric further comprises one of the group of barium titanate or lead zirconium titanate.

4. A method of producing a signal time delayed, phase shifted signal emitted from a phased array radar antenna, which method comprises:

providing a means to generate said signal, said signal having a predetermined frequency;

providing a multiplicity of signal transmission means, each of said signal transmission means having a distinct physical length;

providing at least one signal time delay magnetostatic spin wave device for each of said signal transmission means, said signal time delay magnetostatic spin wave devices comprising a ferrite, said ferrite having a top surface, said ferrite operable to propagate a magnetostatic spin wave, a first transducer for receiving an oscillating signal, said first transducer cooperatively associated with said top surface of said ferrite, a second transducer for detecting said oscillating signal, said second transducer cooperatively associated with said top surface of said ferrite, said second transducer being positioned parallel to said first transducer on said top surface of said ferrite; and a ferroelectric, said ferroelectric mounted upon said top surface of said ferrite, said ferroelectric having a first and a second metalization layer, said first and said second metalization layers positioned opposite one another upon said ferroelectric, said first and said second metalization layers operable to maintain a static electric field between said first and said second metalization layers when a d.c. voltage is electrically connected to said first and said second metalization layers of said ferroelectric, said static electric field operable to time delay said signal propagating through said ferrite, said signal time delay magnetostatic spin wave devices operable to time delay said signals received from said signal transmission means;

providing at least one signal phase shifter in series with each of said signal time delay magnetostatic spin wave devices, said phase shifters operable to phase shift said time delayed signals received from said signal time delay magnetostatic spin wave devices; and providing at least one emitter for each of said signal transmission means, said emitters operable to emit said time delayed, phase shifted signals received from said phase shifters.

5. An improved phased array radar antenna in which a signal generator provides a signal having a predetermined frequency to a multiplicity of signal transmission means having varying physical lengths, and at least one phase shifter for each signal transmission means receives the signal from the signal transmission means, and said phase shifters shift the phase of the received signals prior to the emission of said phase shifted signals through a multiplicity of emitters, wherein the improvement comprises:

at least one signal time delay magnetostatic spin wave device for each of said signal transmission means, said signal time delay magnetostatic spin wave devices comprising a ferrite, said ferrite having a top surface, said ferrite operable to propagate a magnetostatic spin wave, a first transducer for receiving an oscillating signal, said first transducer cooperatively associated with said top surface of said ferrite, a second transducer for detecting said oscillating signal, said second transducer cooperatively associated with said top surface of said ferrite, said second transducer being positioned parallel to said first transducer on said top surface of said ferrite; and a ferroelectric, said ferroelectric mounted upon said top surface of said ferrite, said ferroelectric having a first and a second metalization layer, said first and said second metalization layers positioned opposite one another upon said ferroelectric, said first and said second metalization layers operable to maintain a static electric field between said first and said second metalization layer where a d.c. voltage is electrically connected to said first and said second metalization layers of said ferroelectric, said static electric field operable to time delay said signal propagating through said ferrite, said signal time delay magnetostatic spin wave device positioned in series with said phase shifters, said signal time delay magnetostatic spin wave devices operable to time delay said signals thereby compensating for said varying lengths of said signal transmission means.

* * * * *